US010322907B2

(12) United States Patent
Natarajan

(10) Patent No.: US 10,322,907 B2
(45) Date of Patent: Jun. 18, 2019

(54) ELEVATOR

(71) Applicant: Nithil Karimpanackal Natarajan, Helsinki (FI)

(72) Inventor: Nithil Karimpanackal Natarajan, Helsinki (FI)

(73) Assignee: Kone Corporation, Helsinki (FI)

( * ) Notice: Subject to any disclaimer, the term of this patent is extended or adjusted under 35 U.S.C. 154(b) by 307 days.

(21) Appl. No.: 14/448,245

(22) Filed: Jul. 31, 2014

(65) Prior Publication Data

US 2015/0075918 A1 Mar. 19, 2015

(30) Foreign Application Priority Data

Sep. 17, 2013 (EP) ..... 13184758

(51) Int. Cl.
*B66B 5/00* (2006.01)

(52) U.S. Cl.
CPC ..... *B66B 5/0087* (2013.01)

(58) Field of Classification Search
CPC ..... B66B 1/50; B66B 5/0025; B66B 5/0031; B66B 5/005; B66B 5/0087; B66B 5/0056
USPC ..... 187/359, 360, 377
See application file for complete search history.

(56) References Cited

U.S. PATENT DOCUMENTS 4,004,655 A * 1/1977 Kraft ..... B66B 13/08 187/317
5,679,934 A * 10/1997 Juntunen ..... B66B 1/462 187/384
5,721,403 A * 2/1998 Hoppie ..... B66B 5/0087 187/247
5,749,443 A * 5/1998 Romao ..... B66B 1/468 187/384
6,302,240 B1 10/2001 Shih
(Continued)

FOREIGN PATENT DOCUMENTS

CN 101112954 A 1/2008
CN 101205033 A 6/2008
(Continued)

OTHER PUBLICATIONS

AIPN, Machine Translation, JP 07-206301 A, Jun. 26, 2016, pp. 1-8.*

(Continued)

*Primary Examiner* — Diem M Tran
(74) *Attorney, Agent, or Firm* — Harness, Dickey & Pierce, P.L.C.

(57) ABSTRACT

An elevator including an elevator car having an operating interface including at least one button associated with both manually controlling the motor from inside the interior space during a manual control mode and entering car calls from inside the interior space during an automatic control mode; a controller configured to automatically control the motor to move the elevator car, if the elevator is operating in the automatic control mode, and manually control the motor to move the elevator car based on a user actuating the operating interface such that a movement of the elevator car upwards from an uppermost landing is unobstructed, if the elevator is operating in the manual control mode; and an access control device including a lock, the lock configured to selectively allow or disallow access to the at least one of the plurality of buttons of the operating interface.

10 Claims, 4 Drawing Sheets

(56) References Cited

U.S. PATENT DOCUMENTS

| | | | | |
|---|---|---|---|---|
| 6,405,834 | B1 * | 6/2002 | Chida | B66B 1/46 187/263 |
| 6,630,886 | B2 * | 10/2003 | Malone, Jr. | B66B 5/005 187/390 |
| 6,948,592 | B2 * | 9/2005 | Kavounas | A61N 1/39 187/384 |
| 7,258,202 | B1 * | 8/2007 | Rossignol | B66B 5/005 187/351 |
| 7,568,557 | B2 * | 8/2009 | Rossignol | B66B 11/0233 187/277 |
| 2008/0047783 | A1 * | 2/2008 | Vogl | B66B 5/0087 187/314 |
| 2008/0217114 | A1 | 9/2008 | Felder | |

FOREIGN PATENT DOCUMENTS

| | | | | | |
|---|---|---|---|---|---|
| EP | 1174381 | A1 | * | 1/2002 | B66B 11/002 |
| JP | S6381082 | A | | 4/1988 | |
| JP | 03143889 | A | * | 6/1991 | |
| JP | 07206301 | A | * | 8/1995 | |
| JP | 2013018574 | A | | 1/2013 | |

OTHER PUBLICATIONS

EPO, Machine Translation, EP 1174381 A1, Jun. 27, 2016, pp. 1-10.*

European Search Report for Application No. EP 13184758 dated Mar. 4, 2014.

Office Action dated Oct. 20, 2017 by the Patent Office of China for CN Application No. 20141042572839.

* cited by examiner

ELEVATOR

This application claims priority to European Patent Application No. EP13184758.4 filed on Sep. 17, 2013, the entire contents of which are incorporated herein by reference.

FIELD OF THE INVENTION

The invention relates to an elevator, in particular to the manual control function of an elevator. The elevator is, in particular, meant for transporting passengers.

BACKGROUND OF THE INVENTION

Elevators are normally provided with an elevator car, arranged to be moved with an electric motor. This motor for moving the elevator car is connected to the car in a force-transmitting manner. Typically, the motor is connected to a stationary mounted drive wheel engaging a hoisting roping connected to the car. The rotation of the motor causes rotation of the drive wheel and thereby movement of the hoisting roping. Thus the rotation of the motor is transmitted to the car via the drive wheel and the roping. Accordingly, the movement of the car can be transmitted by controlling rotation of the motor. Also other types of elevators are known, which utilize a motor for producing the movement of the car. Modern elevators are typically provided with a control system, which can be switched between an automatic control mode and a manual control mode. When in automatic control mode, the motor of the elevator is arranged to be automatically controlled by the control system in response to calls from passengers to move the elevator car automatically from one landing to another. When in the manual control mode, the motor is arranged to be manually controllable to move the elevator car a manually controllable distance upwards or downwards, i.e. also a distance other than the vertical distance between any two landings of the elevator, in particular also a distance shorter than the vertical distance between consecutive landings. With the manual control mode, the elevator can be controlled by a maintenance person to move and park the car to practically any position in the hoistway, also to positions between consecutive landings. When in manual control mode, the elevator speed is typically substantially lower than the nominal speed of the elevator car. Indeed, the manual control mode is normally provided so as to serves as a service drive mode. For the purpose of the manual control, the elevator is provided with an operating unit for said manual control, which is mounted on the car roof, and accessible only by entering the hoistway, climbing on the car roof and operating it while standing on the car roof. The operating unit comprises operating means, which are operable manually by a user. A problem with the know solutions is that the manual control necessitates access to the roof, which may in some cases be difficult to arrange. Also, staying on the car roof while the car is moving may cause accidents if the person slips of drives the car too close to the end of the hoistway. For this purpose, additional safety devices have been installed in the hoistway, such as additional safety limits for maintenance-time car movement.

BRIEF DESCRIPTION OF THE INVENTION

The object of the invention is, inter alia, to solve previously described drawbacks of known solutions and problems discussed later in the description of the invention. The object of the invention is to introduce an elevator, wherein the safety of the user is simply ensured during manual control of the elevator. The object is further that said manual control can be allowed for authorized users only. Embodiments are presented wherein these objects are facilitated in a space-efficient manner.

It is brought forward a new elevator comprising an elevator car comprising a cabin box provided with a floor, a roof, walls and preferably also door(s) each delimiting an interior space for receiving a load to be transported with the elevator car. The elevator further comprises at least two landings, a motor for moving the elevator car and a control system for controlling the motor, wherein the control system is provided with an automatic control mode and a manual control mode, in which automatic control mode the motor is arranged to be automatically controlled by the control system in response to calls from passengers to move the elevator car automatically from one landing to another, and in which manual control mode the motor is arranged to be manually controllable to move the elevator car a manually controllable distance upwards or downwards. The elevator further comprises an operating unit for said manual control, the operating unit being mounted on the elevator car and comprising operating means operable manually by a user for said manual control. The car comprises a blocking means operable by a user positioned inside said interior space, the state of the blocking means being changeable between a blocking state and an unblocking state, in which blocking state the blocking means block operation of the operating means for said manual control by a user positioned inside said interior space, and in which unblocking state the blocking means allow operation of the operating means for said manual control by a user positioned inside said interior space, the operating unit being positioned such that the operating means thereof are operable by a user positioned inside said interior space after operation of the blocking means to change their state from blocking state to said unblocking state. The operating means are thus bringable from manually inoperable state to a manually operable state by a user positioned inside said interior space by operation of the blocking means to change their state from blocking state to said unblocking state. The operating means can thus be operated in safe conditions, and operability of them is limited to only those people who can remove the blockage, in practice to only those people who have been authorized to suitable means.

In a preferred embodiment blocking means comprises a lock for locking the blocking means in a blocking state. Thereby the accessibility to the operating means can simply be limited to those authorized users only who have been provided a means for opening the lock.

In a preferred embodiment the blocking means comprise an openable housing inside which the operating means are, and in said blocking state the housing is closed and blocks physical access to the operating means and thereby the operation of the operating means for said manual control by a user positioned inside said interior space, and in said unblocking state the housing is open and physical access to the operating means is unblocked by said housing, thereby allowing operation of the operating means for said manual control by a user positioned inside said interior space. The operating means can thus be made unaccessible to said user positioned inside said interior space unless the housing is opened. Thus a physical blockage limiting access to the operating means is simply provided. In a preferred embodiment the aforementioned lock is arranged to lock the housing in a closed state.

In a preferred embodiment the housing comprises an openable cover, the cover is movable between an closed position where it closes the housing and blocks physical access in to the housing and to the operating means making them manually unoperable to said user, and an open position where physical access in the housing and to the operating means is unblocked by said cover. In particular, the operating means are behind the cover, whereby the cover is between the interior space and the operating means. Thus a physical blockage limiting access to the operating means is simply provided. Preferably, the aforementioned lock is arranged to lock the cover immovable. Preferably, the cover is pivotally mounted, and thereby openable by pivoting movement. In particular, the cover may be mounted by hinges.

In a preferred embodiment the aforementioned lock is openable with a key, in particular with a mechanical key, an electronic key, or a code key. Thus, beneficial alternatives for providing authorization are provided.

In a preferred embodiment the operating means are inside one of said floor, roof and walls. The overall solution thus provided is space-efficient.

In a preferred embodiment the operating unit is at least partly, but preferably completely inside one of said floor, roof and walls. The overall solution thus provided is also space-efficient, as no separate room needs to be provided for the functions contained in the operating unit, and the consumption of the overhead space between the roof of the cabin box of car and the roof of the hoistway is spared, for instance.

In a preferred embodiment the operating unit comprises a battery for providing electric power for electrical devices mounted on the elevator car, such as for lights and/or emergency communication device. Thus, the unit serves as a multipurpose-unit, and the installation of these functions can be provided simply and quickly.

In a preferred embodiment said operating means comprises a first button, upon actuation of which the motor is arranged to move the elevator car upwards as long as the button is actuated e.g. by pressing, and a second button upon actuation of which the motor is arranged to move the elevator car downwards as long as the button is actuated, e.g. by pressing. Thus, the motor is simply arranged to be manually controllable to move the elevator car a manually controllable distance upwards or downwards. The motor is arranged to stop when said actuation ceases.

In a preferred embodiment the operating means are formed by buttons of a button panel mounted on the car for being used in the automatic control mode for receiving car calls from a passenger. Also in this case, the blocking means, when in blocking state, block operation of said operating means formed by buttons, for said manual control by a user positioned inside said interior space and in the unblocking state the blocking means allow operation of the operating means formed by buttons for said manual control by a user positioned inside said interior space. It is preferable, but not necessary, that the elevator is in automatic control mode configured to receive car calls from a passenger (in response to which car calls the car is moved automatically from one landing to another) via these same buttons forming the operating means. Also in this case it is preferable that the blocking means comprises a lock the opening of which is configured to change the blocking means into said unblocking state. This opening preferably also changes the state of the elevator from automatic control mode to the manual control mode.

The elevator as describe anywhere above is preferably, but not necessarily, installed inside a building. The car is preferably arranged to serve two or more landings. The car preferably is arranged to respond to calls from landing(s) and/or destination commands from inside the car so as to serve persons on the landing(s) and/or inside the elevator car. Preferably, the car has an interior space suitable for receiving a load in the form of a passenger or passengers.

BRIEF DESCRIPTION OF THE DRAWINGS

In the following, the present invention will be described in more detail by way of example and with reference to the attached drawings, in which.

DETAILED DESCRIPTION

Figure 1:
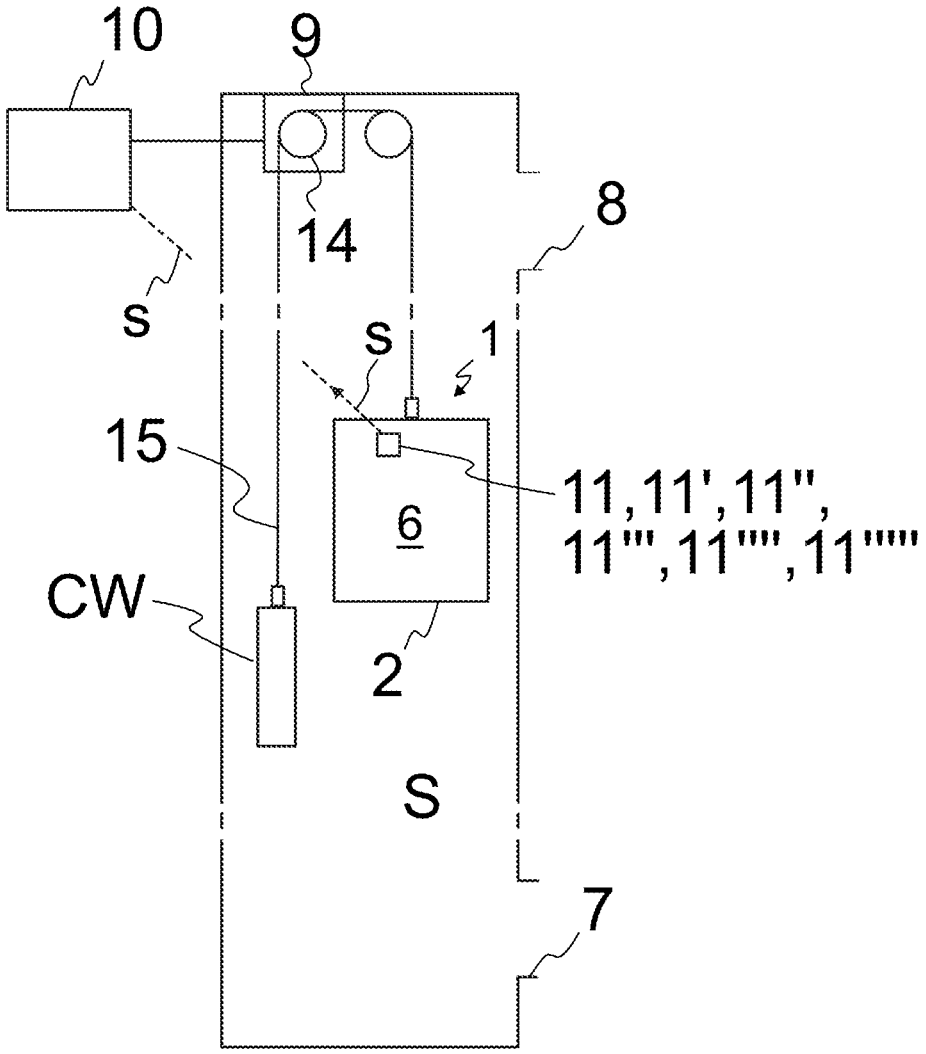
FIG. 1 illustrates an elevator according to an embodiment of the invention.
Figure 2:
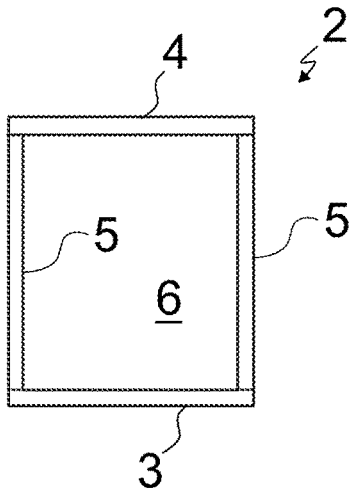
FIG. 2 illustrates the cabin box of FIG. 1 in further details.

FIG. 1 illustrates an elevator according to a preferred embodiment. The elevator comprises an elevator car 1 comprising a cabin box 2, which is illustrated in further details in FIG. 2. The cabin box is provided with a floor 3, a roof 4, walls 5 and preferably also at least one door (not shown) each of these delimiting an interior space 6 for receiving a load to be transported with the elevator car 1. The elevator comprises at least two vertically spaced apart landings 7, 8 between which the elevator car is arranged to travel vertically in a hoistway S. For the purpose of causing car movement, the elevator comprises a motor 9 connected to the car 1 in a force-transmitting manner. In this embodiment, the motor 9 is connected to a stationary mounted drive wheel 14 engaging a hoisting roping 15 connected to the car. The rotation of the motor 9 causes rotation of the drive wheel 14 and thereby movement of the hoisting roping 15. Thus the rotation of the motor 9 is transmitted to the car 1 via the drive wheel 14 and the hoisting roping 15. Accordingly, the movement of the car can be transmitted by controlling rotation of the motor 9. The motor 9 is arranged to be controlled with a control system 10, 11, 11',11",11''', 11'''',11'''''. The control system 10,11, 11', 11", 11''', 11'''', 11"" is provided with an automatic control mode and a manual control mode, in which automatic control mode the motor is arranged to be automatically controlled by the control system in response to calls from passengers to move the elevator car 1 automatically from one landing to another, e.g. from landing 7 to landing 8 or vice versa. In the manual control mode the motor is arranged to be manually controllable to move the elevator car 1 any manually controllable distance upwards or downwards, i.e. a distance equal, longer or shorter than the distance between landings 7,8 of the elevator. The switching between these modes can be provided in a known manner, as it is well known to provide an elevator with an automatic control mode (i.e. the normal use mode) and a manual control mode (i.e. a service mode). For said manual control, in particular for the purpose of receiving manual control commands from a user, the elevator comprises an operating unit 11,11',11",11''',11'''',11'''''. This operating unit 11,11',11",11''',11'''',11''''' is mounted on the elevator car 1 and it comprises operating means 12,12',12", 12''',12'''',12''''' operable manually by a user for said manual control, i.e. for inputting manual control commands.

Said operating means 12,12',12",12''',12'''',12''''' preferably comprises a first (upwards) button, upon actuation of which the motor 9 is arranged to move the elevator car 1 upwards as long as the button is actuated, and a second (downwards) button upon actuation of which the motor 9 is arranged to move the elevator car 1 downwards as long as the button is actuated. Thus, the motor 9 is arranged to be manually controllable to move the elevator car 1 a manually controllable distance upwards or downwards;

The operating unit 11,11',11",11''',11'''',11''''' is positioned such that the operating means 12,12',12",12''',12'''',12''''' thereof are operable by a user positioned inside said interior space 6 after removing a removable blockage. The blockage is provided for the purpose of delimiting access to the operating means 12,12',12",12''',12'''',12''''' to only those people who can remove the blockage, in practice to only those people who have been authorized. This function is provided for such that the car 1 comprises a blocking means 13,13',13",13''',13'''',13''''' operable by a user 14 positioned inside said interior space 6, the state of the blocking means being changeable between a blocking state and an unblocking state. In the blocking state the blocking means block operation of the operating means 12,12',12",12''',12'''',12''''' for said manual control by a user positioned inside said interior space 6, and in the unblocking state the blocking means allow (i.e. they don't block) the operation of the operating means 12,12',12",12''',12'''',12''''' for said manual control by a user positioned inside said interior space 6. Both the operation of the blocking means 13,13',13",13''',13'''', 13''''' and the operation of the operating means 12,12',12", 12''',12'''',12''''' (after removing said blockage) can be performed by a person positioned inside said interior space 6. The operating means 12,12',12",12''',12'''',12''''' are thereby bringable by operation of the blocking means (performed by a user positioned inside said interior space 6) to change their state from blocking state to said unblocking state, from a state wherein they are manually inoperable to a user positioned inside said interior space 6 to a state wherein they are manually operable to user positioned inside said interior space 6. In the preferred embodiments said user is a maintenance person.

Figure 3:
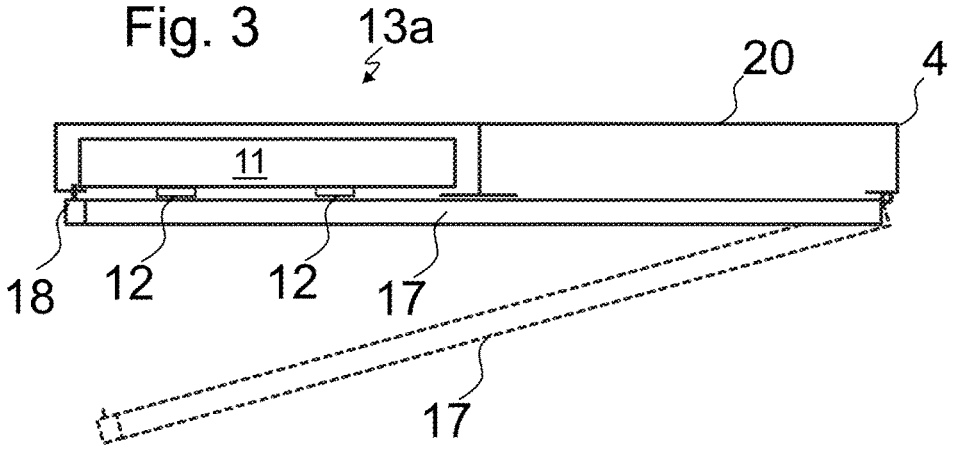
FIG. 3 illustrates the operating unit in its position according to a first embodiment as viewed in horizontal direction.
Figure 4:
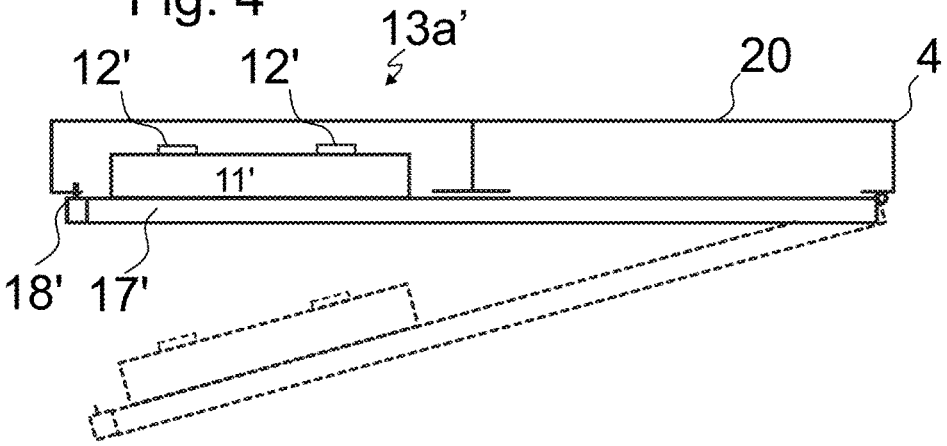
FIG. 4 illustrates the operating unit in its position according to a second embodiment as viewed in horizontal direction.
Figure 5:
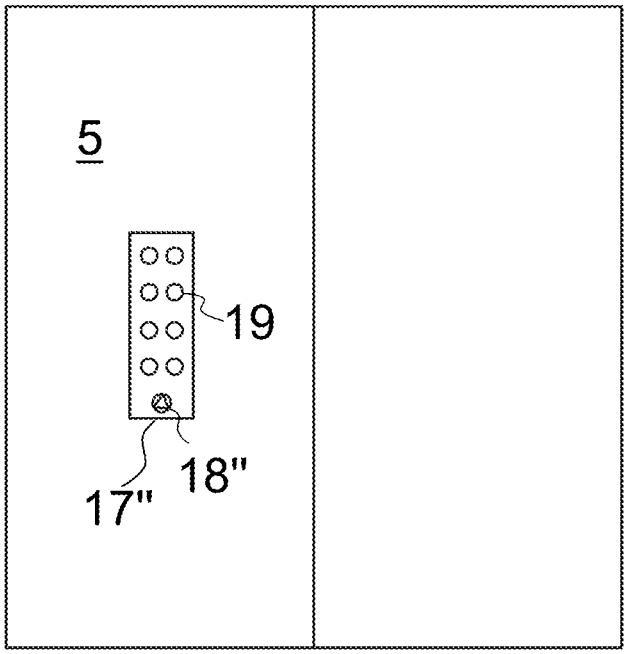
FIG. 5 illustrates the operating unit in its position according to a third embodiment as viewed from inside the interior space in horizontal direction.

FIGS. 3, 4 and 5 each illustrate an embodiment, where said blocking means 13, 13', 13" comprise an openable housing 13*a*, 13*a*', 13*a*" inside which the operating means 12, 12', 12" are contained. In said blocking state the housing is closed and blocks physical access to the operating means 12, 12', 12" and thereby the housing blocks physically also the operation of the operating means 12, 12', 12" for said manual control by a user positioned inside said interior space 6. In said unblocking state the housing 13*a*, 13*a*', 13*a*" is open and physical access to the operating means is unblocked by said housing 13*a*, 13*a*', 13*a*", the housing 13*a*, 13*a*', 13*a*" thereby allowing operation of the operating means 12, 12', 12" for said manual control by a user positioned inside said interior space 6. The operating means 12, 12', 12"are thus unaccessible to said user positioned inside said interior space 6 unless the housing is opened. In particular, the housing 13*a*, 13*a*', 13*a*" comprises an openable cover 17, 17', 17", and the operating means 12, 12', 12" are behind the cover 17, 17', 17". The cover 17, 17', 17"is between the interior space 6 and the operating means 12, 12', 12". In the preferred embodiment, the cover 17, 17', 17" is movable between a closed position where it closes the housing 17, 17', 17" and blocks physical access into the housing 13*a*, 13*a*', 13*a*" and to the operating means 12, 12', 12" making them manually unoperable to said user, and an open position where physical access in the housing 13*a*, 13*a*', 13*a*" and to the operating means 12, 12', 12" is unblocked by said cover 17, 17', 17".

Preferably, the blocking means 13, 13', 13" further comprises a lock 18, 18', 18" for locking the blocking means 13, 13', 13" in a blocking state. Particularly, the lock 18, 18', 18" is arranged to lock the housing 13*a*, 13*a*', 13*a*" in a closed state, which is preferably implemented such that the lock 18, 18', 18" is arranged to lock the cover 17, 17', 17" immovable. Said lock 18, 18', 18" is openable with a with a key, in particular with a triangular key. It is preferable, that the cover 17, 17', 17" is pivotally mounted (and thereby openable by pivoting movement), for example via hinges as illustrated in FIGS. 3-5. As further illustrated, it is preferable that not only the operating means 12,12',12" but the complete operating unit 11, 11', 11" is inside the housing 13*a*, 13*a*', 13*a*". Thus, a space efficient solution can be provided which is easy to install. It is thus also easy to integrate several additional functions into the operating unit 11,11', 11", such as a battery 21 for providing electric power for electrical devices mounted on the elevator car (e.g. for the car lights or the door operator) at least during power failures and/or an emergency communication device 22 for providing a communication from the car to a remote service center. It should be appreciated that the housing can have any other shape than illustrated.

In the embodiments illustrated in FIGS. 3 and 4, the operating unit 11,11', and thereby also its operating means 12,12' are mounted inside the roof 4, which roof 4 forms said housing 13*a*,13*a*'. The blocking means 13,13' can be changed to unblocking state by working in the interior space 6 below the housing 13*a*,13*a*'. The housing 13*a*,13*a*' is openable in these embodiments by moving the cover 17,17' downwards, in this case with a pivotal movement. The cover 17,17' is a lower face plate of the roof 4 limiting the interior space 6. The roof 4 further comprises an upper face plate 20, the operating unit 11,1" being positioned between the upper face plate 20 and the lower face plate 17,17'. The embodiments of FIGS. 3 and 4 differ in that the operating unit 11 is in the embodiment of FIG. 3 mounted stationary behind the cover 17 and in FIG. 4, the operating unit 11' is mounted on the cover 17' to move along with the cover 17' when it is opened. The FIGS. 3 and 4 illustrate with solid line the housing 13*a*,13*a*' in closed state and with broken line the housing housing 13*a*,13*a*' in opened state.

Figure 6:
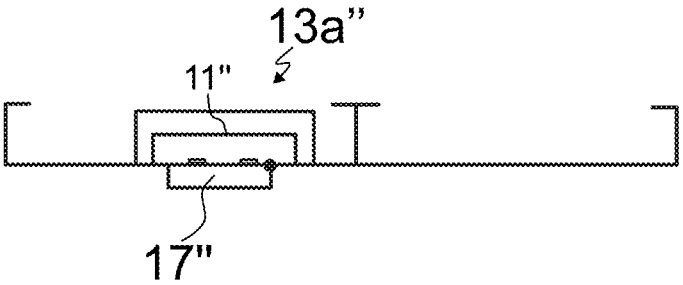
FIG. 6 illustrates the operating unit in its position according to a third embodiment as viewed in vertical direction when the housing is closed.
Figure 7:
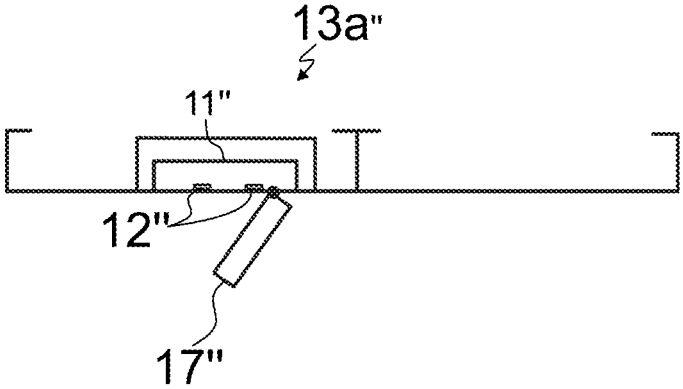
FIG. 7 illustrates the operating unit in its position according to a third embodiment as viewed in vertical direction when the housing is open.

In the embodiment illustrated in FIGS. 6 and 7, the operating unit 11", and thereby also its operating means 12"

are mounted inside the wall 5, which wall forms said housing 13*a*". The blocking means 13" can be changed to unblocking state by working in the interior space 6 below beside the housing 13*a*". The housing 13*a*,13*a*' is openable in these embodiments by moving the cover 17" sideways, in this case with a pivotal movement. The cover 17" is a face plate of the wall 5 limiting the interior space 6. In the preferred embodiment, the cover 17" is a panel used for receiving car calls from the passenger during normal use of the elevator, i.e. during the automatic control mode of the elevator, for which purpose the cover 17" comprises buttons 19 or alternatively a touch screen.

Figure 8:
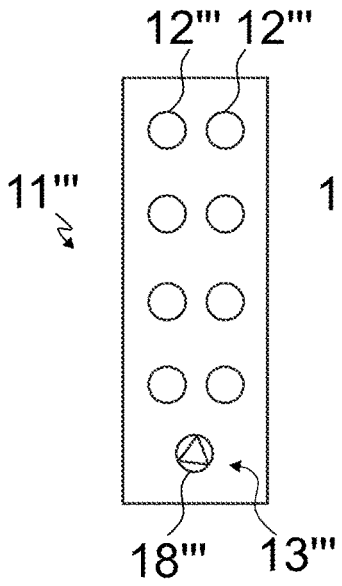
FIG. 8 illustrates the operating unit in its position according to a fourth embodiment as viewed from inside the interior space in horizontal direction.
Figure 9:
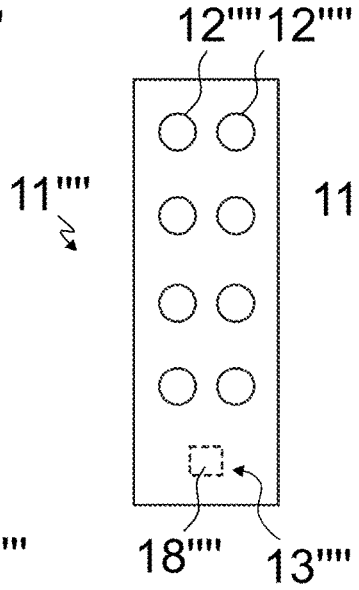
FIG. 9 illustrates the operating unit in its position according to a fifth embodiment as viewed from inside the interior space in horizontal direction.
Figure 10:
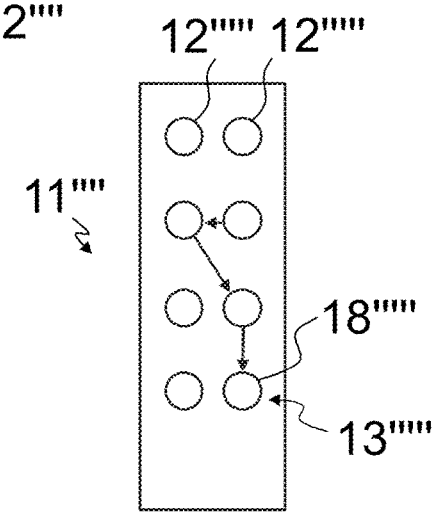
FIG. 10 illustrates the operating unit in its position according to a sixth embodiment as viewed from inside the interior space in horizontal direction.

FIGS. 8, 9 and 10 each illustrate an embodiment, where the operating means 12''', 12'''', 12''''' are formed by the buttons of a button panel mounted on the car 1 for being used in the automatic control mode for receiving car calls from a passenger. The blocking means 13''', 13'''', 13''''' in these cases, when in blocking state, block operation of the operating means 12''''', 12''''', 12''''', for said manual control by a user positioned inside said interior space 6. In the unblocking state the blocking means 13''', 13''''', 13''''' allow operation of the operating means 12''', 12''''', 12''''' for said manual control by a user positioned inside said interior space 6. When the elevator is in automatic control mode, the blocking means 13''', 13''''', 13''''' are in blocking state and when the elevator is in manual control mode the blocking means 13''', 13''''', 13''''' are in unblocking state. It is preferable, but not necessary, that the elevator is configured to receive car calls from a passenger (in response to which car calls the car is moved automatically from one landing to another) via these same buttons forming the operating means 12''', 12''''', 12''''' when the elevator is in automatic control mode. FIGS. 8, 9 and 10 show different types of blocking means. In the embodiment illustrated in FIG. 8 the blocking means 13''' comprises a mechanical lock 18''', in particular a triangular lock, openable with a mechanical key, in particular with a triangular key. The opening of the lock is configured to change the blocking means into said unblocking state. In embodiment illustrated in FIG. 9 the blocking means 13''''' comprises an electronically actuatable lock 18''''', in particular a lock openable with a RF-identification means such as an RF-tag. The opening of the lock is configured to change the blocking means into said unblocking state. In embodiment illustrated in FIG. 10 the blocking means 13''''' comprises a code lock 18''''' openable by feeding a code via the button panel, in particular by pressing predefined buttons in a predefined order (illustrated with arrows). The opening of the lock 18''''' is configured to change the blocking means into said unblocking state. In any of the embodiments of FIGS. 8-10, the blocking means, in particular the lock 18''',18''''',18''''' thereof, may comprise a processor (not shown) configured to control the state of the blocking means 13''',13''''',13''''' in response to operation thereof by a user.

Figure 11:
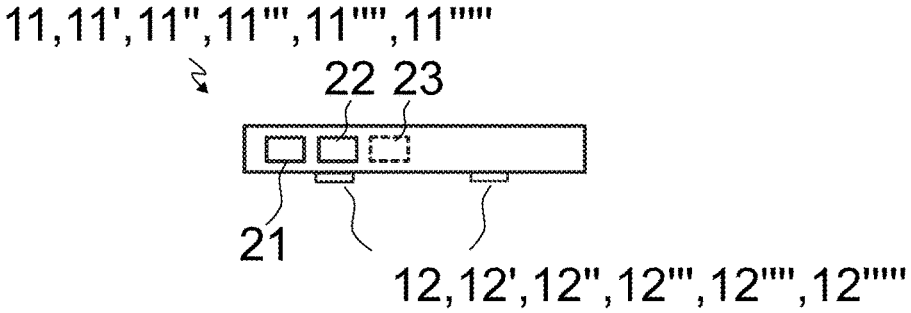
FIG. 11 illustrates a side view of the operating unit as such according.to a preferred embodiment.

FIG. 11 illustrates the operating unit 11,11',11",11''',11''''', 11''''', when functions additional to said manual control function are integrated into it. The operating unit 11,11',11", 11''',11''''',11''''' comprises a battery 21 for providing electric power for electrical devices mounted on the elevator car (1), such as for lights as well as an emergency communication device 22. The operating unit 11,11',11",11''',11''''',11''''' may further comprise a control unit 23 for controlling a door drive (not shown) for controlling the door moving (electric) motor of the car door(s), which motor is connected to the door(s). In the case wherein one or more of said additional functions are integrated into the operating unit it is especially beneficial that the operating unit 11,11',11",11''',11''''', 11''''' is at least partly, preferably completely, inside one of said floor 3, roof 4 and wall 5. Thus, the unit serves as a multipurpose-unit, and the installation of these functions can be provided simply and quickly. The overall solution thus provided is also space-efficient, as no room needs to be provided for the functions in several places, and the consumption of the overhead space between the roof of the cabin box 2 of car 1 and the roof of the hoistway S is minimized.

It is preferable that, as illustrated in FIG. 1, the elevator control system is such that it comprises a drive unit 10 connected to the motor 9, which drive unit 10 in said automatic control mode automatically controls the motor 9 in response to calls from passengers to move the elevator car 1 automatically from one landing to another. For this purpose, the drive unit 10 is provided with a frequency converter regulating the supply of electricity to the motor 9, as well as one or more processors configured to set a speed reference according to which the frequency converter is configured to regulate the supply of electricity to the motor 9. Said one or more processors are preferably configured to set the speed reference according to an algorithm stored in a memory of the drive unit 10. The operating unit 11,11', 11",11''',11''''',11''''' is preferably arranged to communicate with the drive unit 10 during the manual control mode. There may be, for instance a wired or wireless data transfer bus (as in the FIG. 1) for transmitting a control signal s between them. A control signal s carrying a control command manually inputted via the operating means 12,12',12",12''',12''''', 12''''' by a user positioned inside said interior space 6, can thereby be transmitted from the operating unit 11,11',11", 11''',11''''',11''''' to the drive unit 10. During the manual control mode, said one or more processor, which are preferably microprocessors, are configured to set the speed reference, which provides a car speed which is lower than the nominal speed of the elevator. Thus, the manual control is well suitable for safe maintenance drive of the elevator. During the manual control mode, said one or more processor also is able to set the speed reference to zero independent of car position, which is carried out in response to a predefined change in signal from the operating unit 11,11',11",11''',11''''', 11''''' which change is associated with zero speed. Thus, during manual control mode, the car 1 can be stopped independent of car position. This is preferably provided such that said operating means 12,12',12",12''',12''''',12''''' comprises a first (upwards) button, upon actuation of which the motor 9 is arranged to move the elevator car 1 upwards as long as the button is actuated, and a second (downwards) button upon actuation of which the motor 9 is arranged to move the elevator car 1 downwards as long as the button is actuated. The details in this paragraph describe how the automatic control mode and manual control mode are provided in a preferred embodiment. However, in the field of elevator technology also alternative ways for providing the automatic control mode and the manual control mode are known, which could alternatively be utilized in combination with the specific solutions related to the means for blocking access to the operating unit 11,11',11",11''',11''''',11''''' and/or position thereof.

It is to be understood that the above description and the accompanying Figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. An elevator comprising:

an elevator car having at least a cabin box, the cabin box including a floor, a roof, walls, and at least one door defining an interior space for receiving a load in the elevator car;

a motor configured to move the elevator car;

an operating interface in the interior space of the elevator car, the operating interface including a plurality of buttons, at least one of the plurality of buttons being associated with both manually controlling the motor from inside the interior space during a manual control mode and entering car calls from inside the interior space during an automatic control mode;

a controller configured to control the motor by:

automatically controlling the motor to move the elevator car automatically in an elevator shaft between landings of the elevator shaft, if the elevator is operating in the automatic control mode, and manually controlling the motor to move the elevator car in the elevator shaft based on a user actuating the operating interface such that a movement of the elevator car upwards from an uppermost one of the landings of the elevator shaft is unobstructed, if the elevator is operating in the manual control mode; and an access control device including a lock, the lock configured to selectively allow or disallow access to the at least one of the plurality of buttons of the operating interface.

2. The elevator according to claim 1, wherein the lock is openable with a key, the key including at least one of a mechanical key, an electronic key, a code key, and a radio frequency identification tag.

3. The elevator according to claim 1, wherein the operating interface is positioned on at least one of the floor, the roof and at least one wall of the cabin box.

4. The elevator according to claim 1, wherein the operating interface is at least partly or entirely inside at least one wall of the cabin box.

5. The elevator according to claim 1, further comprising:

an openable housing including the operating interface and a battery, the battery configured to power electrical devices associated with the elevator car, the electrical devices including at least one of lights, emergency communication devices, the operating interface, the motor, and the controller.

6. The elevator according to claim 1, wherein the plurality of buttons of the operating interface include:

a first button configured to move the elevator car upwards as long as the first button is actuated such that the movement of the elevator car is unobstructed as the elevator car approaches the top of the elevator shaft, and a second button configured to move the elevator car downwards as long as the second button is actuated such that the movement of the elevator is unobstructed as the elevator car approaches a bottom of the elevator shaft.

7. The elevator according to claim 1, wherein the operating interface is operable in the manual control mode by the user, if the access control device allows the user to access the operating interface, and the operating interface is inoperable in the manual control mode, if the access control device disallows the user to access the operating interface.

8. A control system configured to control an elevator car of an elevator, the control system comprising:

an operating interface in an interior space of the elevator car, the operating interface including a plurality of buttons, at least one the plurality of buttons being associated with both manually controlling a motor during a manual control mode and entering car calls during an automatic control mode;

a controller configured to control the motor by, automatically controlling the motor to move the elevator car automatically in an elevator shaft between landings of the elevator shaft, if the elevator is operating in the automatic control mode, and manually controlling the motor to move the elevator car in the elevator shaft based on the user actuating the operating interface such that a movement of the elevator car upwards from an uppermost one of the landings of the elevator shaft is unobstructed; and an access control device including a lock, the lock configured to control access to the at least one of the plurality of buttons of the operating interface.

9. The control system according to claim 8, wherein the lock is openable with a key, the key including at least one of a mechanical key, an electronic key, a code key, and a radio frequency identification tag.

10. The control system according to claim 8, wherein the operating interface is at least partly or entirely inside at least one wall of a cabin box of the elevator car.

* * * * *